United States Patent [19]

Svensson et al.

[11] 4,141,211

[45] Feb. 27, 1979

[54] TRAVERSING DEVICE IN A CHAIN MANUFACTURING PLANT

[75] Inventors: Stig Svensson; Carl-Henning Camitz; Stig Lindgren, all of Ramnäs, Sweden

[73] Assignee: Bulten-Kanthal AB, Hallstahammar, Sweden

[21] Appl. No.: 864,038

[22] Filed: Dec. 23, 1977

[30] Foreign Application Priority Data

Dec. 30, 1976 [SE] Sweden ..... 7614749

[51] Int. Cl.[2] ..... B21L 7/00

[52] U.S. Cl. ..... 59/16; 59/18; 59/22

[58] Field of Search ..... 59/1, 3, 16, 18, 25, 59/31, 32, 34, 35, 22

[56] References Cited

U.S. PATENT DOCUMENTS

| | | | |
|---|---|---|---|
| 845,877 | 3/1907 | Lysholm | 59/34 |
| 3,701,251 | 10/1972 | Andreasson | 59/32 |
| 3,945,198 | 3/1976 | Linden | 59/16 |
| 3,977,180 | 8/1976 | Booth | 59/31 |
| 4,000,606 | 1/1977 | Linden | 59/16 |

*Primary Examiner*—C.W. Lanham
*Assistant Examiner*—Gene P. Crosby
*Attorney, Agent, or Firm*—Pollock, Vande Sande & Priddy

[57] ABSTRACT

A traversing device in a plant for manufacturing chains. A carriage for carrying the chain end under production is movable along a guide on at least one side of a rectilinear production line comprising different work stations. The guide is mounted on at least one traverse beam movable transversely relative to the rectilinear production line, so that the chain end can be moved aside from the rectilinear production line to at least one additional work station, e.g., for re-orientation of the last link element.

5 Claims, 1 Drawing Figure

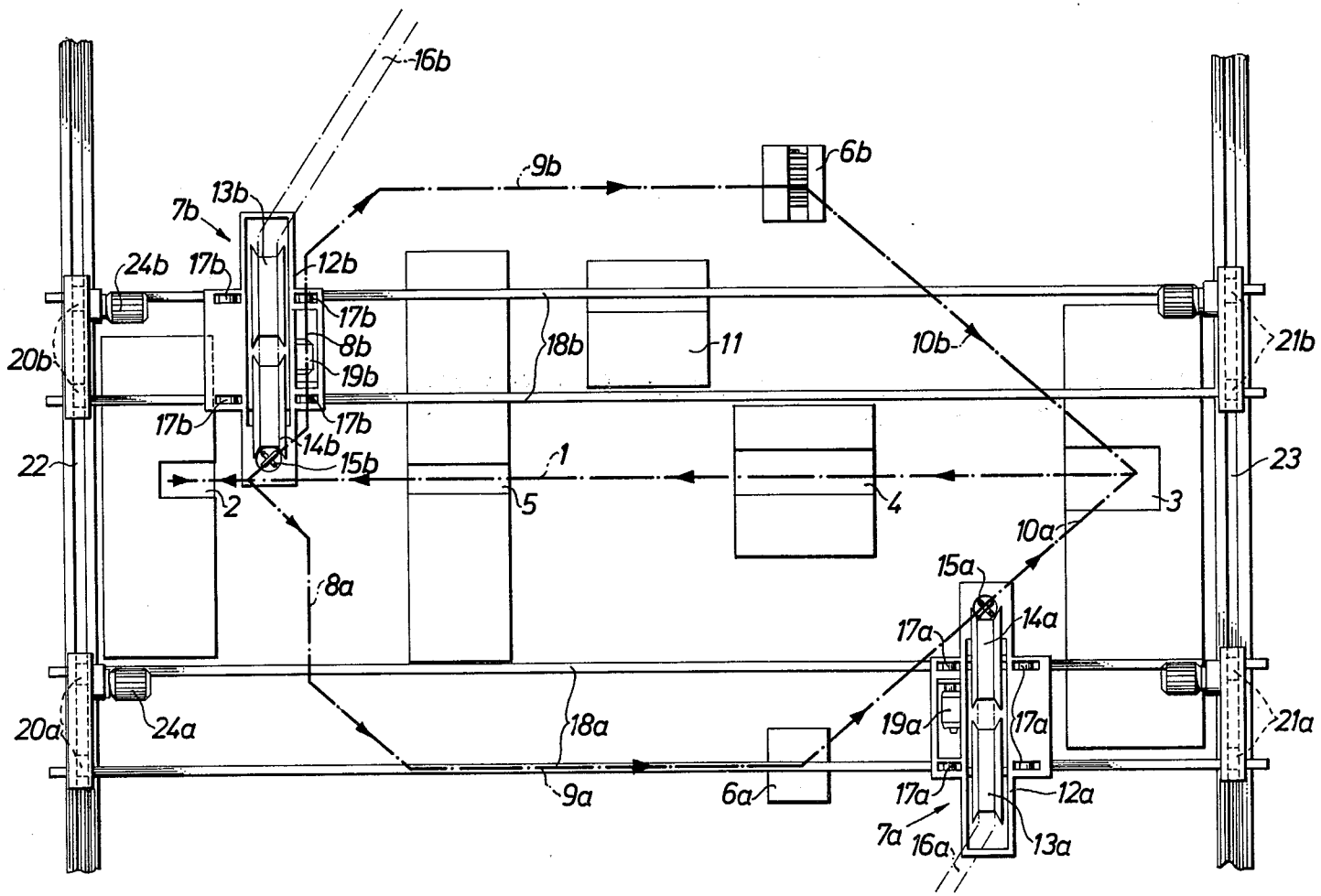
21b
23
21a
3
10a
14a
17a
12a
13a
15a
17a
19a
17a
16a
7a
10b
4
6b
6a
11
18b
1
5
18a
9a
9b
16b
12b
17b
8b
19b
17b
15b
14b
8a
13b
7b
17b
2
17b
24b
24a
20b
22
20a

TRAVERSING DEVICE IN A CHAIN MANUFACTURING PLANT

BACKGROUND OF THE INVENTION

The invention relates to a traversing device in a plant for manufacturing chains, in particular heavy chains, wherein a carriage for carrying the chain end under production is movable along a guide on at least one side of a rectilinear production line comprising different work stations, such as stations for bending a new link element and introducing same into the previously produced link of the chain, welding the bent link element, trimming the weld, and possibly inserting a support element into the last link thus produced.

Such a traversing device is known from Swedish Pat. No. 7314459-4, wherein the production line is rectilinear and limited on each side by a guide supporting a carriage, these guides being constituted by stationary rails. Each carriage has a chain supporting structure in the form of a crab, which is movable in the transverse direction and permits the carriages to pass each other during the simultaneous manufacture of the two chains.

This arrangement with stationary guides has substantial drawbacks. When the carriage is moved along its stationary rails, strong side forces will be exerted on the crab carrying the chain end by the fed out, ready-made chain, which usually is fed out via a stationary stand to a collecting station. Due to these side forces, the transverse mobility of the crab must either be very limited or the structure must be given very large dimensions, so that the crab and the carriage will resist the forthcoming side forces even when the crab is displaced far away from its central position relative to the rails. However, such dimensioning of the structure is disadvantageous because of increased installation and maintenance costs.

Thus, in the known device, the stationary rails carrying each carriage and the corresponding crab must be placed rather close to the rectilinear production line.

When developing chain manufacturing plants, however, it has proven advantageous to arrange at least one more work station outside the rectilinear production line, e.g., a station for re-orienting the relative position of the recently introduced link element, which should take place between the bending and welding stations (these two stations are normally located at each end of the production line). Further, it is desirable to be able to move the carriage, so that the chain end hanging down therefrom will be transported at a great distance from the production line, whether the work stations are manually or automatically operated.

Particularly in the case of automated work stations, it is furthermore advantageous not to have to hoist and lower the chain end, i.e. to enable the same, in one direction, to freely pass each work station. Although, at each automated station automatic positioning of the last link to be worked takes place, such positioning requires a relatively exact pre-positioning both vertically and sideways. This pre-positioning will of course be facilitated if the chain end merely has to be displaced upwards or downwards in correspondence substantially to the length of one link.

SUMMARY OF THE INVENTION

A traversing device according to the invention, the principal features of which are stated in the attached claims, has proven extremely makes it possible to transport in one direction, the hanging chain end at a great transverse distance from the work stations, to arrange a special work station, viz. a link re-orienting device, at the side of the main production line, and to adjust the plant for automatic link processing at the various stations.

BRIEF DESCRIPTION OF THE DRAWING

The invention will be explained more fully below with reference to the attached drawing, illustrating schematically, in plan view, a chain manufacturing plant with a traversing device according to the invention.

DESCRIPTION OF AN EXEMPLARY EMBODIMENT

The drawing illustrates a straight chain production line 1, which comprises four work stations, viz. a bending station 2 for bending a new link element and introducing same into the last link of the chain, a welding station 3 for welding together the end portions of the link element, a trimming station 4 for trimming the weld bead, and a support mounting station 5 for clamping a support element inside the welded link element.

The illustrated plant is intended for simultaneous manufacture of two chains, and for each chain, outside the straight production line 1, there is a link revolving station **6*a* and 6*b*, respectively. Such a link revolving station is described in detail in Swedish Pat. No. 7614748-7 and is adapted to re-orient the bent and adjoined link element into an orientation suitable for the subsequent welding operation at welding station 3**, in which the substantially C-shaped link element is positioned in a vertical plane with its longitudinal axis oriented horizontally.

The end portions of each chain are carried, respectively, by carriages **7*a* and 7*b*, movable in two dimensions and automatically guided along a cyclical path 8*a*, 9*a*, 10*a*, 1 and 8*b*, 9*b*, 10*b*, 1, respectively, under manual supervision from a control console 11**.

The plant is substantially symmetrical relative to production line 1, so that the following description regarding carriage **7*a*, the guidance thereof, etc., is applicable also to carriage 7*b***.

Carriage **7*a* comprises a frame 12*a*, in which two chain wheels 13*a* and 14*a* are journalled and synchronously drivable by means of drive and transmission means (not shown) for hoisting or lowering the chain end 15*a* and for feeding away the ready-made chain 16*a* to a collecting station. Carriage 7*a* travels by means of four wheels 17*a* on two rails 18*a* parallel to production line 1, and can be displaced into a desired position by means of a motor 19*a*, driving at least one and preferably all of the four wheels 17*a***.

In accordance with invention, the rails **18*a* are not stationary but jointly movable in a transverse direction relative to production line 1 by being mounted on a rigidly connected pair of beams carried at their ends by wheels 20*a* and 21*a*, respectively, travelling along traverse guides 22, 23, the latter guides being disposed about 3 m above the floor level outside the end stations 2, 3 of production line 1 and oriented perpendicularly to same. At least one of the four wheels 20*a*, 21*a* is driven by a motor 24*a*, whereby the carriage 7*a* can be moved at will in two dimensions above the plant floor at one side of the production line 1, e.g. along the chain-dotted cyclical path 8*a*, 9*a*, 10*a*, 1. Correspondingly, carriage 7*b* can be moved along the cyclical path 8*b*, 9*b*, 10*b*, 1**.

Through this possibility of moving carriages *7a*, *7b* at a great transverse distance from the production line 1, the chain manufacture can be practically entirely automated, which has hitherto not been possible. After a new link element is bent and adjoined at the automatic bending machine 2, the hanging chain end is moved sideways along the path 8*a*, 9*a*, at a proper distance from the support mounting station 5 and up to the link revolver 6*a* and 6*b*, respectively, where the chain end is lowered towards the driven rollers thereof (see Swedish Pat. No. 7614748-7), so that the longitudinal axis of the last adjoined link element is horizontally oriented. After lowering the link revolving table with the driven rollers, the thus oriented link element hangs freely and is moved along path 10*a* and 10*b*, respectively, to automatic welding station 3, where only a fine adjustment of the link element by means of programmed guiding arms is necessary. Correspondingly, only a fine adjustment by means of automatically working positioning arms or the like is necessary at the subsequent stations 4, 5 and 2. The entire process is pre-programmed, so that the two carriages *7a*, *7b* will not even get close to each other. Normally, only one person is needed to supervise the process from the control console.

We claim:

1. A traversing device for use in a plant for the manufacture of chains having a rectilinear production line with a plurality of work station, comprising (a) a guide means extending along at least one side of said production line and being substantially parallel to said production line;

(b) at least one traverse beam for mounting said guide means;

(c) stationary traverse guides arranged perpendicularly to said production line for carrying said at least one traverse beam;

(d) a carriage for carrying a chain end under production, said carriage being movable along said guide means;

(e) said guide means and said carriage movable therealong being movable transversely relative to said production line;

(f) said traverse guides having a length such that said carriage, in a first position of said guide means, can move along the latter with said chain end hanging down on said production line, and, in a second position of said guide means, retracted from said production line, can move along said guide means with said chain end hanging down at a distance from said production line sufficient to permit said chain end to avoid said work stations on said production line without being hoisted, thereby permitting the insertion of at least one further work station laterally of said rectilinear production line.

2. A traversing device according to claim 1, wherein said at least one traverse beam is carried on said traverse guides at its ends.

3. A traversing device according to claim 1, wherein said traverse guides are arranged beyond the ends of said rectilinear production line.

4. A traversing device according to claim 1, wherein said work stations on said rectilinear production line comprise a station for bending a new link element of a said chain and introducing said link into a preceding link of said chain, and a station for welding said bent link element.

5. A traversing device according to claim 1, wherein said further work station comprises a link revolving station for changing the orientation of the last link of said chain to a position suitable for subsequent welding.

* * * * *